US005400807A

United States Patent [19]

Newman

[11] Patent Number: 5,400,807

[45] Date of Patent: Mar. 28, 1995

[54] WATER PIPE SMOKING APPARATUS HAVING IMPACT COLLARS AND BASE STORAGE COMPARTMENT

[76] Inventor: Mark R. Newman, P.O. Box 17009, Tucson, Ariz. 85731

[21] Appl. No.: 140,538

[22] Filed: Oct. 25, 1993

[51] Int. Cl.[6] ..... A24F 1/02

[52] U.S. Cl. ..... 131/173

[58] Field of Search ..... 131/173; 220/732; 206/521

[56] References Cited

U.S. PATENT DOCUMENTS

| | | | |
|---|---|---|---|
| D. 265,595 | 7/1982 | Galanter | D27/3 |
| 845,777 | 3/1907 | Grossman | 220/732 X |
| 1,462,291 | 7/1923 | McCrink | 220/732 X |
| 2,774,502 | 12/1956 | Novak | 220/732 X |
| 3,445,051 | 5/1969 | Goldman | 206/521 X |
| 3,872,872 | 3/1975 | Kahler | 131/173 |
| 3,881,499 | 5/1975 | McFadden et al. | 131/173 |
| 4,044,781 | 8/1977 | Heggestuen | 131/173 |
| 4,108,152 | 8/1978 | Kahler | 131/173 |
| 4,170,237 | 10/1979 | Epstein | 131/173 |
| 4,183,365 | 1/1980 | Kelley | 131/173 X |
| 4,187,885 | 2/1980 | Kahler | 131/173 X |
| 4,216,785 | 8/1980 | Erickson et al. | 131/173 |
| 4,357,948 | 11/1982 | Schweitzer et al. | 131/173 |
| 4,682,610 | 7/1987 | Freelain | 131/173 |
| 5,111,975 | 5/1992 | Roberts | 220/732 X |

*Primary Examiner*—Jennifer Bahr
*Attorney, Agent, or Firm*—Victor Flores

[57] ABSTRACT

A liquid pipe smoking apparatus having impact collars formed to be carried by the body of the base member, and or, the vessel body of the apparatus. The impact collars are detachable and are intended to absorb shock encountered by the apparatus during use to avoid fracture of the vessel body, and or to avoid tipping of the pipe apparatus. The cylindrical base member is also modified such that the underside portion provides a storage compartment covered with a threaded or friction retained bottom cap member. Various embodiments may be configured utilizing the impact collars and the modified base structure.

10 Claims, 3 Drawing Sheets

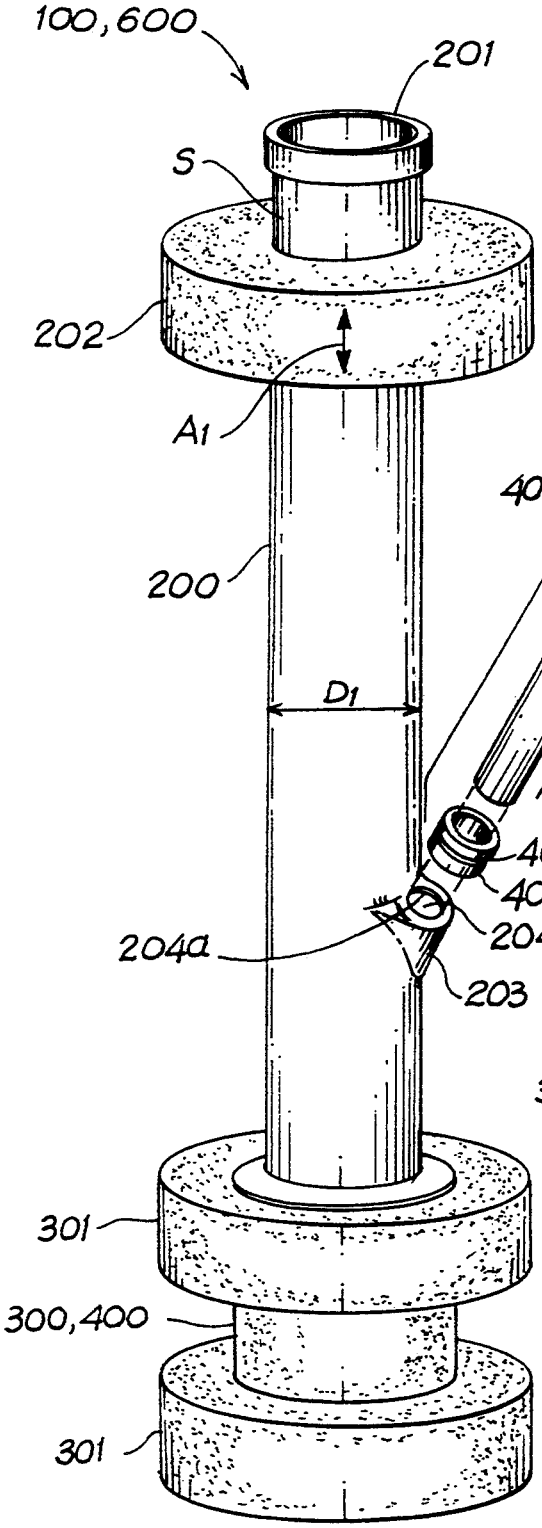
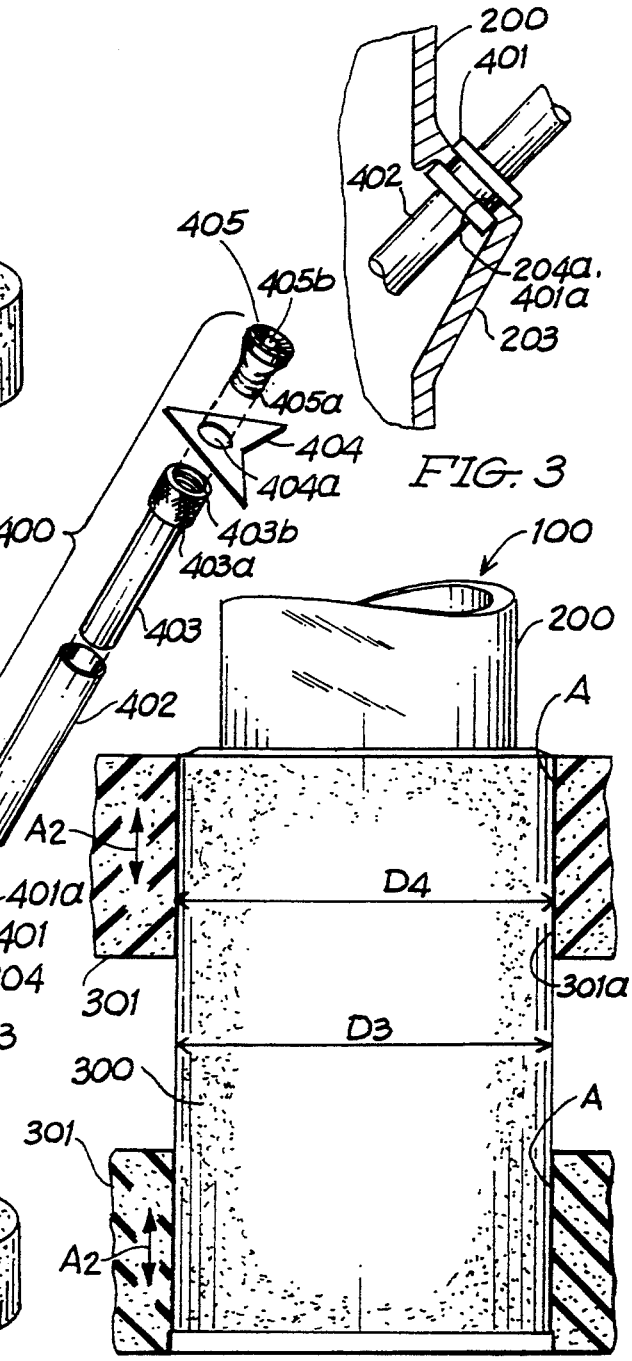
FIG. 2
FIG. 3
FIG. 1

WATER PIPE SMOKING APPARATUS HAVING IMPACT COLLARS AND BASE STORAGE COMPARTMENT

FIELD OF THE INVENTION

The present invention relates to pipe smoking devices. More particularly, the present invention relates to water pipe smoking devices that are provided with structure for absorbing shock and providing storage for smoking substances.

BACKGROUND OF THE INVENTION

The prior art water pipe smoking apparatus are known to comprise a cylindrical, weighted base member onto which an elongated cylindrical vessel body is fixedly, or detachably attached. Typically, the cylindrical vessel body includes a mid-length entry port for attachment of a stem member which comprises an interface portion leading into the vessel and a bowl portion for containing the smoking substance. During use, the elongated vessel body contains water, or other suitable liquid, which filters the smoking substance. The material used to make the vessel is typically a translucent acrylic material, which after use, typically becomes brittle and susceptible to fracture. Representative of this type of pipe apparatus is U.S. Pat. Des 265,595 showing ornamental aspects of a pipe apparatus.

The foregoing pipe smoking structure during use has been found to be very susceptible to inadvertent contact with surrounding furniture objects, doors, or other surrounding home fixtures, causing impact shock to the pipe and subjecting the vessel body to possible fractures, or generally causing an unstable condition of the upright pipe resulting in spillage of the liquid contained in the vessel. Since the pipe smoking apparatus is elongated, impact at the upper end of the vessel body in particular causes an unstable condition. Also, since the weighted base member is typically only 1.3 times larger in diameter than the vessel body, the prior art base structure is not considered sufficiently broad to prevent tipping of the upright elongated pipe structure. The prior art pipe structure does not provide structure to absorb shock from inadvertent bumping against objects.

Further, the prior art base structures used on pipe apparatus as described above have not been fully utilized to provide storage for smoking substances, or other articles. While a need to have storage in a pipe smoking device has been recognized, the storage solutions are not deemed adequate, see U.S. Pat. No. 4,108,152 which teaches a storage compartment at the upper mouth end of the pipe device.

Further, pipe apparatus having a base/vessel structure, as describe above, have not been provided with shock impact collars in combination with a base member having a storage compartment.

Thus, a need is seen to exist for a pipe smoking apparatus which provides impact collars suitably located on the pipe apparatus to prevent fracture of the vessel body and to absorb shock to minimize tipping and spilling of liquids contained in the vessel body.

A need is further seen to exist for a pipe smoking apparatus having impact collars, as described above, and also having a base member provided with a storage compartment.

A need is further seen to exist for a pipe smoking apparatus having impact collars which may be removed to facilitate cleaning of the apparatus.

A need is further seen to exist for a pipe smoking apparatus as described above, having a base member provided with a storage compartment, but which may be optionally adapted with impact collars suitably located on the pipe structure.

SUMMARY OF THE INVENTION

Accordingly, the primary object of the present invention is to provide a liquid pipe smoking apparatus which is provided with at least one impact collar to absorb shock to the pipe structure to prevent fracture of the vessel body and to minimize tipping and spilling of liquids contained in the vessel body.

Another object of the present invention is to provide a liquid pipe smoking apparatus having impact collars, as described above, and also having a base member provided with a storage compartment.

Yet another is to provide a pipe smoking apparatus having impact collars which may be removed to facilitate cleaning of the apparatus.

Still another object of the present invention is to provide a pipe smoking apparatus having a base member provided with a storage compartment, and which may be optionally adapted with impact collars suitably located on the pipe structure, as described above.

The foregoing objects are accomplished by providing a pipe smoking apparatus comprising a cylindrical base designed to support a vessel member modified with the elements of the present invention. At least one impact collar is formed to surround the body of the apparatus such that any impact occurring on the impact collar results in the shock being absorbed by the impact collar, to thus avoid fracture of the vessel body, and or to avoid tipping of the pipe apparatus. The cylindrical base is also modified such that the underside portion is provided with a storage compartment comprising a cavity portion covered with a threaded or friction retained bottom cap member. Various embodiments may be configured utilizing the impact collars. By example, embodiments provided with or without the storage compartment in the base member may be configured. Similarly, the pipe apparatus may be provided only with the storage compartment in the modified base. The support offered to the vessel body by the base member may be by permanent attachment of the two elements, or by an arrangement whereby the vessel body is detachable from the base member.

Therefore, to the accomplishments of the foregoing objects, the invention consists of the foregoing features hereinafter fully described and particularly pointed out in the claims, the accompanying drawings and the following disclosure describing in detail the invention, such drawings and disclosure illustrating the preferred embodiment in which the invention may be practiced.

BRIEF DESCRIPTION OF THE DRAWINGS

FIG. 1 is a view of a water pipe smoking apparatus illustrating impact collar members disposed on the vessel body structure and on the base structure, the base member being optionally adapted with the storage compartment in accordance with the invention.

FIG. 2 illustrates a partial view, in cross-section, of the impact collar members on a base member depicted by example without a storage compartment, and also illustrating that the impact collar members are detachable.

FIG. 3 illustrates a cross-sectional view of the pipe bowl stem interface attachment at the vessel body.

DESCRIPTION OF THE PREFERRED EMBODIMENT

Figure 4:
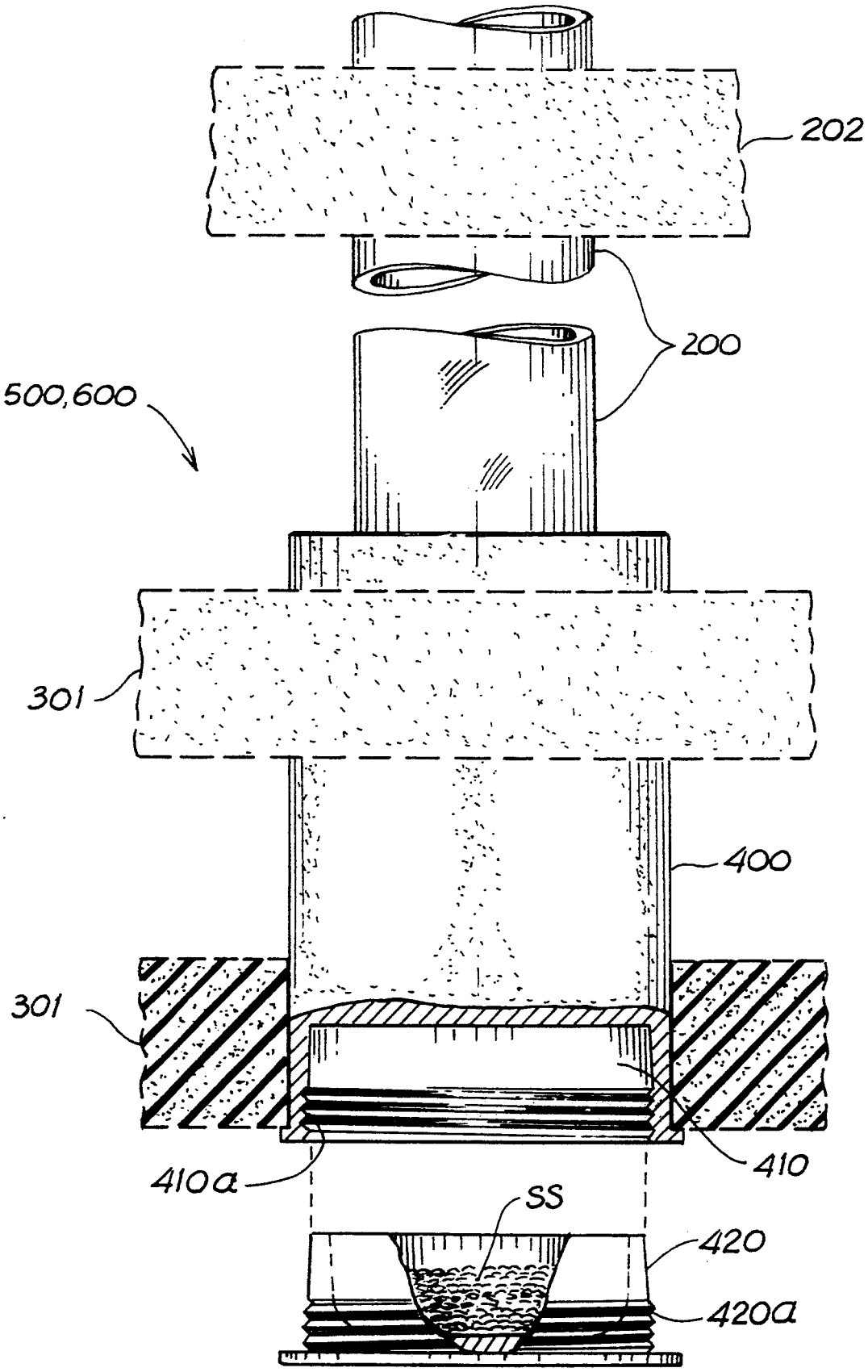
FIG. 4 is a fragmented view of a pipe apparatus in accordance with the present invention illustrating in particular a cutaway view of the storage compartment provided in the underside portion of the base member.

FIG. 1 illustrates a water pipe smoking apparatus 100, 600 which comprises an elongated cylindrical vessel body 200 having a mouth ring member 201 and supported by a base 300, 400 (each configuration provided with a respective impact collar 202, 301), and a stem member assembly 400 provided with a bowl 405 for containment of a smoking substance. As depicted, pipe smoking embodiment 100 comprises a base member 300 without the storage compartment and pipe smoking embodiment 600 comprises a base member 400 with a storage compartment. As discussed earlier, the elongated vessel body 200 contains the liquid which filters the smoking substance. As depicted in FIG. 1, and detailed in FIG. 3, vessel body 200 is formed having an angularly protruding dimple portion 203 having a walled access port 204, 204*a* (dimple) designed for angular installation of stem assembly 400. Stem assembly 400 comprises a grommet 401, a first stem member 402, a second stem member 403, a stem finger hold member 404 and a bowl 405. Grommet 401 receives stem member 402 which are secured to vessel 200 via a mechanically coupled arrangement of wall rim 204*a* and grommet groove 401*a*. Second stem member 403 is removably inserted into first stem member 402 and is provided with a threaded knurled portion 403*a*, 403*b*. Threads 403*b* receive threads 405*a* of bowl 405 and therebetween secure stem finger holder member 404 via hole 404*a*. Bowl 405*b* is used to contain smoking substance.

Figure 5:
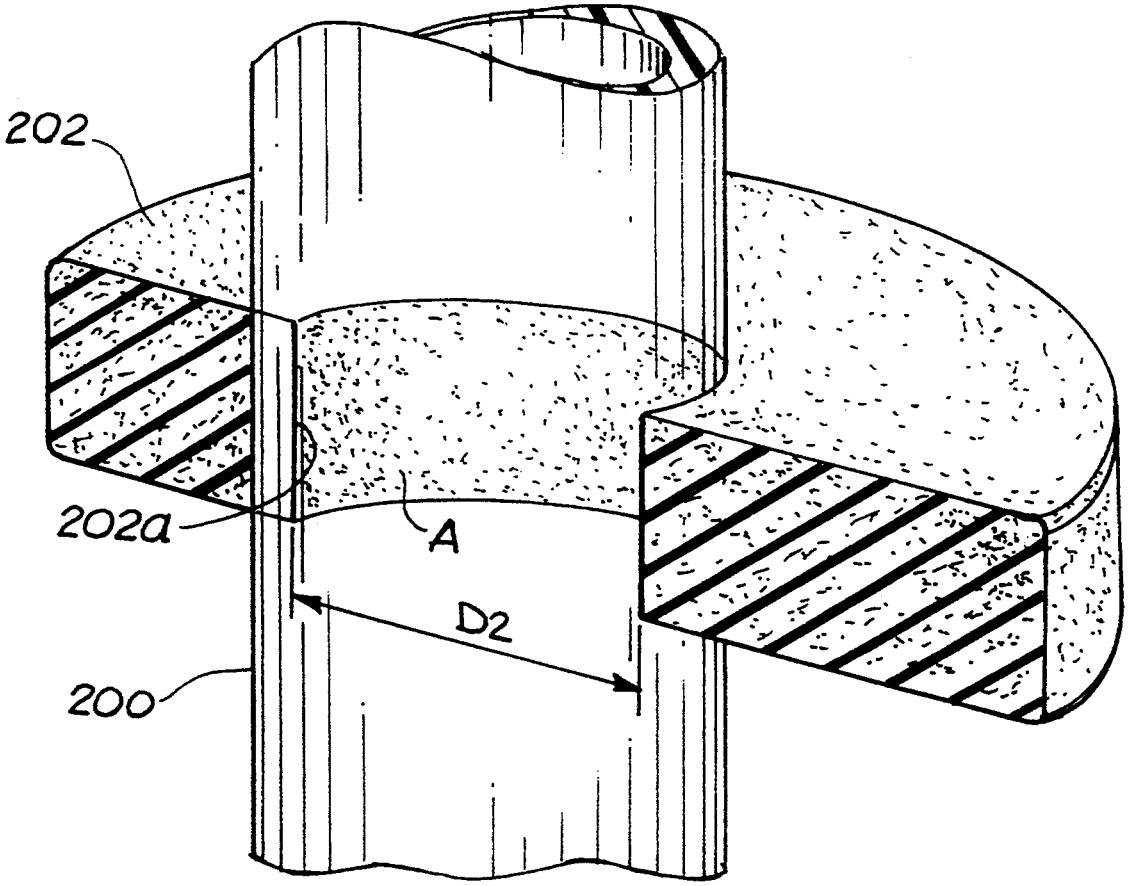
FIG. 5 is a partial view of the water pipe's vessel body adapted with a detachable impact collar and illustrating, in cross-section, the closed-cell cellulose material provided with an adhesive barrier that facilitates detachment.

FIG. 1 illustrates an upper end portion of a tubular vessel body 200 having an outer diameter D1. Vessel 200 is typically formed from a translucent acrylic material having a smooth outer surface S and an interior diameter D2, see FIG. 5. Since any number of impact collar members may be suitably disposed along any desired point of the body of vessel 200, the interior ring 202*a* of an impact collar 202, see FIG. 5, is provided with an adhesive A that provides a friction barrier to facilitate positioning an impact collar at a desired location along vessel 200. The friction barrier facilitates an impact collar 202 to be move as indicated by arrow A1, for positioning, or for cleaning the vessel surface S. Similarly, as shown in FIG. 2, impact collars 301 are also provided with an adhesive A to provide a friction barrier to facilitate movement A2. The impact collars 202, 301 are sized to fit over either the vessel body 200, or over the base member 300. Typically, the impact collars 301 are sized larger in diameter than collars 202 for fitting over the body of base member 300. As also depicted in FIG. 2, and also in FIG. 5, the diameter of the inner ring 202*a*, 301*a* of impact collars 202, 301 is stretched to a diameter D2, D4 that is greater than the diameter D1, D3 of the vessel, base, respectively, such that a tight fit is produced to aid the adhesive in securing the impact collars 202, 301 in place. Also, impact collars 202, 301, referred to also as shock absorbing members, are preferably formed from a closed-cell polyether material.

FIG. 4 illustrates pipe smoking embodiment 500 without impact collar members, but with a base member 400 adapted with a storage compartment 410 and cap 420. Embodiment 600 would enhance embodiment 500 by adding the impact collars 202, 301. As depicted in FIG. 5, the underside of base member 400 is adapted with a storage compartment 410 provided with threads 410*a* for threadedly engaging threads 420*a* of cap 420. Cap 420, by example, contains smoking substance SS which is conveniently stored and kept fresh when secured within compartment 410.

Therefore, while the present invention has been shown and described herein in what is believed to be the most practical and preferred embodiment, it is recognized that departures can be made therefrom within the scope of the invention, which scope is therefore not to be limited to the details disclosed herein but is to be accorded the full scope of the claims so as to embrace any and all equivalent apparatus.

I claim:

1. A pipe smoking apparatus, said apparatus comprising:

a base structure;

a vessel body structure, said vessel body being received within and supported by said base structure;

a storage compartment formed in said base structure, said storage compartment comprising a cavity portion covered with a disengagable cap member contacting said base structure, said vessel body being formed having a wall access port for installation of a stem assembly provided with a bowl for containment of a smoking substance; and at least one shock absorbing collar member sized for being detachably secured to said apparatus, said detachable securement aspect facilitating said shock absorbing collar member being selectively moved to a desired location on said apparatus.

2. A pipe smoking apparatus as recited in claim 1, wherein:

said at least one shock absorbing collar member being detachably secured to said vessel body structure.

3. A pipe smoking apparatus as recited in claim 1, wherein:

said at least one shock absorbing collar member comprises a plurality of shock absorbing members detachably secured to said vessel body structure and to said base structure.

4. A pipe smoking apparatus as recited in claim 1, wherein:

said storage compartment being formed within an underside portion of said base structure and said cap member being threadedly engaged to said cavity portion.

5. A pipe smoking apparatus as recited in claim 1, wherein:

said at least one shock absorbing member being formed from a closed-cell polyether material.

6. A pipe smoking apparatus, said apparatus comprising:

a base structure;

a vessel body structure, said vessel body structure being received within and supported by said base structure, said vessel body structure being formed having a wall access port;

a stem assembly installed to said access port, said stem assembly being provided with a bowl for containment of a smoking substance;

a plurality of shock absorbing collar members detachably secured to said apparatus, a first type of said plurality of shock absorbing collar members being adapted for facilitating detachable securement to said vessel body structure, said detachable securement facilitating said first type of shock absorbing collar members being selectively positioned at a desired location on an outer surface of said vessel body structure, and a second type of said plurality of shock absorbing collar members being adapted for facilitating detachable securement to said base structure, said detachable securement facilitating said second type of shock absorbing collar members being selectively positioned on said base structure; and a storage compartment formed in said base structure; and a removable cap member in contact with said base structure for covering said storage compartment.

7. A pipe smoking apparatus as recited in claim 6, wherein:

said storage compartment being formed within an underside portion of said base structure and comprising a cavity portion including engagement means for engaging said removable cap member.

8. A pipe smoking apparatus, said apparatus comprising:

a base structure;

a vessel body structure, said vessel body structure being received within and supported by said base structure, said vessel body structure being formed having a wall access port;

a stem assembly installed to said access port, said stem assembly being provided with a bowl for containment of a smoking substance; and a storage compartment formed in said base structure, said storage compartment comprising a cavity portion in said base structure and a removable cap member in contact with said base structure for covering said cavity portion.

9. A pipe smoking apparatus as recited in claim 8, further comprising:

a plurality of shock absorbing collar members detachably secured to said vessel body structure and to said base structure, said plurality of shock absorbing collar members being shaped having a truncated ring design, a first type of said plurality of shock absorbing collar members being adapted for facilitating detachable securement to said vessel body structure, said detachable securement facilitating said first type of shock absorbing collar members being selectively positioned at a desired location on an outer surface of said vessel body structure, and a second type of said plurality of shock absorbing collar members being adapted for facilitating detachable securement to said base structure, said detachable securement facilitating said second type of shock absorbing collar members being selectively positioned on said base structure; and said storage compartment being formed within an underside portion of said base structure.

10. A pipe smoking apparatus as recited in claim 9, wherein:

each of said plurality of shock absorbing collar members being formed from a closed-cell polyether material.

* * * * *